US005566751A

United States Patent [19]

Anderson et al.

[11] Patent Number: 5,566,751

[45] Date of Patent: Oct. 22, 1996

[54] VENTED VAPOR SOURCE

[75] Inventors: William G. Anderson; Kevin H. Richardson, both of Lancaster; Scott D. Garner, Lititz, all of Pa.

[73] Assignee: Thermacore, Inc., Lancaster, Pa.

[21] Appl. No.: 446,502

[22] Filed: May 22, 1995

[51] Int. Cl.[6] ..... F28D 15/00

[52] U.S. Cl. ..... 165/104.27; 165/104.26

[58] Field of Search ..... 165/104.34, 104.27, 165/104.26, 104.21

[56] References Cited

U.S. PATENT DOCUMENTS

| | | | |
|---|---|---|---|
| 3,435,283 | 3/1969 | Beurtheret et al. | 165/104.27 X |
| 3,503,438 | 3/1970 | Geyer | 165/104.27 X |
| 4,106,557 | 8/1978 | Sonobe et al. | 165/104.27 |
| 4,254,820 | 3/1981 | Asselman et al. | 165/104.27 X |
| 4,287,941 | 9/1981 | Allen | 165/104.32 X |
| 4,336,837 | 6/1982 | Koenig | 165/104.26 X |
| 4,586,561 | 5/1986 | Franco et al. | 165/10.27 X |
| 4,627,487 | 12/1986 | Basiulius | 165/104.27 X |
| 4,706,740 | 11/1987 | Mahefkey | 165/104.27 |
| 4,782,890 | 11/1988 | Shimodaira et al. | 165/104.27 |
| 4,884,628 | 12/1989 | En-Jian et al. | 165/10.27 X |
| 4,886,048 | 12/1989 | Labaton et al. | 165/104.27 |
| 4,901,790 | 2/1990 | Meijer | 165/104.27 X |
| 4,917,178 | 4/1990 | Kosson et al. | 165/104.27 X |
| 5,113,927 | 5/1992 | Kedar et al. | 165/104.27 |

FOREIGN PATENT DOCUMENTS

| | | | |
|---|---|---|---|
| 0121450 | 9/1978 | Japan . | |
| 0041360 | 3/1980 | Japan . | |
| 0042091 | 4/1981 | Japan | 165/104.27 |

*Primary Examiner*—John Rivell
*Assistant Examiner*—Christopher Atkinson
*Attorney, Agent, or Firm*—Martin Fruitman

[57] ABSTRACT

The apparatus is a non-condensible gas venting device for vapor sources which can include a sonic orifice for vapor pressure reduction in high vapor pressure systems. A typical vapor source has a evaporator chamber with an evaporating wick containing liquid which is heated and produces vapor. The invention is a venting chamber connected to the evaporator chamber so that the vapor has access to the venting chamber. The venting chamber also includes a condensing wick interconnected to the evaporating wick in the evaporator chamber by a capillary capillary device through which the condensed liquid is returned to the evaporating wick. The condenser chamber is vented to a lower pressure region or vacuum so that non-condensible gas present moves out of the condenser chamber into the lower pressure while the vapor is trapped by the condensing wick and is retained in the system.

6 Claims, 4 Drawing Sheets

VENTED VAPOR SOURCE

BACKGROUND OF THE INVENTION

The invention deals generally with heat transfer apparatus which is based on change of state and evaporation/condensation systems such as heat pipes and vapor sources, and more specifically with a vapor source which automatically purges itself of any non-condensible gases which may exist in the vapor region.

There are several applications in which vapor devices are required to operate under conditions in which such devices are in a hydrogen atmosphere and subjected to intense heat. Heat pipe heat exchangers operating in hydrogen or flue gas environments are one, and nuclear propulsion systems for space are another. Under such conditions the hydrogen may permeate into the vapor device and affect its operation.

Nuclear propulsion systems which have been proposed for use in space involve a dual mode of operation. Such systems combine thermal propulsion and electric power generation in a single integrated unit. For propulsion, the nuclear reactor heats hydrogen within the core and exhausts it through a nozzle. At the same time, thermal energy from the reactor is converted to electricity by thermionic or other thermal to electric energy converters. Such thermal energy converters may be located either inside or outside the reactor core. The heat can be transferred to the thermal energy converters either directly from the heated hydrogen or from heat pipes which are in contact with the hot hydrogen and transfer the heat to more remote thermal energy converters.

Unfortunately, one of the characteristics of hydrogen is its ability to permeate through metal, particularly when the metal is at high temperature. This has caused problems in transferring reactor core heat to thermionic energy converters because the hydrogen present permeates directly into either the thermionic energy converters or the heat pipes which are used to transfer heat to the thermionic energy converters. When hydrogen enters either device the result is premature failure of the electrical generation system.

The thermionic energy converters fail because the hydrogen interferes with the thermionic process, even at very low hydrogen partial pressures of less than 100 Pascal. Alkali metal heat pipes are also appropriate for the temperatures developed within a nuclear reactor, but they will eventually stop operating because the hydrogen is swept to the condenser region and prevents access of the vapor to the condenser. Preliminary calculations indicate that most of the heat pipe condensers used in dual mode nuclear propulsion systems would be blocked after less than three hours of operation of the propulsion unit.

SUMMARY OF THE INVENTION

The present invention is a vent for non-condensible gas which can be used in conjunction with vapor dependent devices such as alkali metal vapor sources, thermionic energy converters and heat pipes, all of which can be associated with a dual mode nuclear reactor propulsion system. The invention continuously removes any non-condensible gases, including hydrogen, from a vapor source, thermionic energy converter or heat pipe with which it is associated. The invention therefore prevents the accumulation within the devices of sufficient non-condensible gas to prevent them from operating.

The preferred embodiment of the invention is a vapor source with an evaporator chamber with a vapor pressure reduction orifice connecting it to a low pressure venting chamber that includes a vent to an even lower pressure region, for instance, a vacuum region. The invention disposes of any non-condensible gas which is present, in the low pressure venting chamber by venting it to the lower pressure region.

The evaporator chamber has an evaporating wick containing liquid, and the evaporating wick is heated by an external heat source to produce vapor from the liquid. This vapor is produced in the evaporator chamber at high pressure because of the high temperature to which the evaporating wick is subjected. The high pressure evaporator chamber is connected to a venting chamber through a sonic orifice so that the pressure in the venting chamber is dramatically lower than the pressure in the evaporator chamber.

The venting chamber contains a condensing wick which is cooled, and therefore acts as a vapor condenser. The condensing wick is interconnected to the evaporating wick in the evaporator chamber by a capillary means such as an artery. Thus, vapor entering the venting chamber because of the pressure differential between the evaporator chamber and the venting chamber condenses at the condensing wick, and the liquid condensing at the condensing wick is returned to the evaporating wick in the evaporator chamber through the interconnecting artery by capillary action.

The venting chamber is also vented to a lower pressure region, such as a vacuum, so that any non-condensible gas present in the system is swept into and through the venting chamber by the vapor and is removed from the system as it continues to move through the vent to the lower pressure or vacuum region. The vapor is, however, prevented from venting to the vacuum because it is captured by the condensing wick in the venting chamber. Vapor deflectors can be added to the venting chamber to aid in the capture of the vapor, and these deflectors can be constructed of wick material and cooled to further aid in collecting the vapor.

Such a non-condensible gas venting chamber can be used with both thermionic energy converters and heat pipes. Since a typical thermionic energy converter, such as a cesium converter, operates with a uniform internal pressure of vapor, it can be connected with the venting chamber of the invention's vapor source, with the sonic orifice selected to create the proper vapor pressure. The vapor will then diffuse both into and out of the thermionic converter through the interconnection. While the vapor improves the operation of the thermionic converter, its movement into and out of the thermionic converter will cause hydrogen which has permeated in through the converter walls to be swept out of the converter and into the venting chamber. This hydrogen will then vent to vacuum as described above.

Moreover, the thermionic converter can also be constructed as the connecting structure between the evaporator chamber and the venting chamber of the invention. In such a structure the flow of the alkali metal vapor through the thermionic converter as it moves from the evaporator chamber to the venting chamber flushes the hydrogen out of the thermionic converter with a positive action.

An alternate embodiment of the invention can be used in conjunction with a heat pipe. When the non-condensible gas vent is used with a heat pipe, the structure is only slightly different from its use with an alkali metal vapor source. For instance, with a heat pipe which uses an alkali metal as a heat transfer medium, the heat pipe's condensing region is interconnected with the venting chamber through the pressure reducing sonic orifice. This essentially adds a second condensing wick to the previous embodiment. This second condensing wick is located within the heat pipe, and the heat pipe acts as a vapor source for the venting chamber. The second condensing wick within the heat pipe is also interconnected with the evaporating wick as in any conventional heat pipe. The venting chamber into which the sonic orifice supplies vapor is constructed as previously described, with its own condensing wick, with an artery interconnecting the venting chamber condensing wick to the heat pipe evaporating wick, and with a vent to vacuum.

Since a conventional heat pipe operates at high vapor pressure, the action of the complete heat pipe is the same as the simpler evaporating chamber alone. Alkali metal vapor, or any other vapor, generated within the heat pipe evaporator not only moves to the condensing wick within the heat pipe, but a small amount of vapor also moves through the sonic orifice. The condensing wick within the heat pipe returns the condensed liquid to the evaporating wick for evaporation, but the condensing wick in the venting chamber also returns the small amount of liquid it condenses to the same single evaporating wick.

In effect, the vapor movement, the condensing, and the capillary return of liquid to the evaporating wick has two possible paths. The first path is completely within the heat pipe. However, the heat pipe is also acting as the evaporator chamber of the vapor source which supplies the venting chamber, and the second path, which is quite restricted, is through the sonic orifice and into the venting chamber where the vapor is condensed and the resulting liquid returned to the heat pipe's evaporating wick through the capillary artery connected to the wick in the venting chamber. It is this second path which any non-condensible gas present in the heat pipe must follow, because such gas will not enter the heat pipe's condensing wick, and the vapor moving through the sonic orifice sweeps the gas with it.

Thus, the invention operates essentially the same whether a vapor source's evaporator contains only an evaporating wick alone, or also includes the condensing wick of an integrated heat pipe which merely shunts most of the vapor back to the evaporating wick before it enters the venting chamber. As long as there is access from the vapor source into the venting chamber, any non-condensible gas in the vapor source will enter into the venting chamber, and then exit the venting chamber to the lower pressure or vacuum region.

In fact, the venting chamber of the invention can be viewed as a non-condensible gas vent which includes a vapor trap to catch the vapor which escapes with the non-condensible gas, and then returns that vapor to the evaporator chamber in liquid form. However, regardless of whether the invention is considered a vented vapor source or a vent and vapor trap for a heat pipe or thermionic converter, the result is the same. When the invention is used with any device, it retains the desirable vapor in the operating system while disposing of the detrimental non-condensible gases.

DETAILED DESCRIPTION OF THE INVENTION

Figure 1:
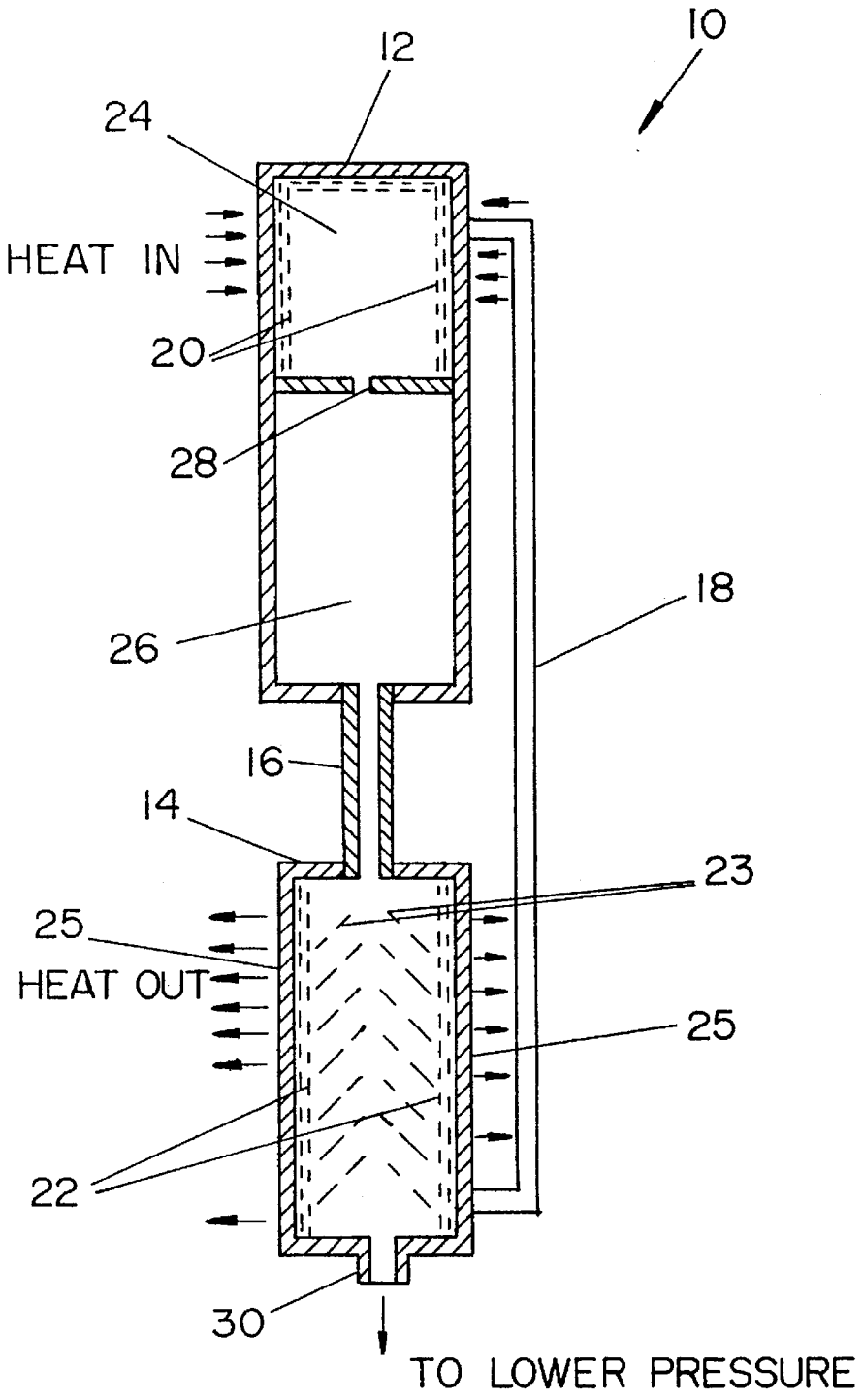
FIG. 1 is a simplified cross section schematic diagram of the preferred embodiment of the invention.

FIG. 1 is a simplified cross section schematic diagram of vented vapor source 10 of the preferred embodiment of the invention in which evaporator chamber 12 is interconnected with venting chamber 14 by tubing 16, and artery 18 interconnects evaporating wick 20 in evaporator chamber 12 with condensing wick 22 in venting chamber 14.

When heat is applied to evaporator chamber 12, liquid within evaporating wick 20 is vaporized within high pressure section 24 of evaporating chamber 12. For instance, in a typical embodiment using cesium, with the evaporator chamber heated at 900 degrees Kelvin, the vapor pressure generated within high pressure section 24 is 66 KPa.

This vapor at high pressure leaves high pressure chamber 24 and enters low pressure section 26 of evaporator chamber 12 through sonic orifice 28. The essential characteristic of sonic orifice 28 is that a substantial pressure drop occurs across it, so that, for cesium, the vapor pressure in low pressure chamber 26 is the order of 1/100th of the vapor pressure in high pressure section 24. The orifice may take the form of a fixed plate orifice or may be adjustable such as with a valve. In the typical embodiment using cesium at 900 degrees Kelvin, the vapor pressure in low pressure section 26 is 530 Pa. It is thus possible to reduce the pressure at which a vapor is accessible even though the temperature available to generate the vapor produces a much higher pressure. This resulting lower vapor pressure can then be used directly in venting chamber 14.

In the preferred embodiment shown in FIG. 1, the reduced vapor pressure is utilized to vent non-condensible gases, such as hydrogen, from the vapor source or any device interconnected with it.

To accomplish this, low pressure section 26 of evaporator chamber 12 is interconnected to venting chamber 14 which contains condensing wick 22, and the heat within venting chamber 14 and condensing wick 22 is removed from cooled surfaces 25 by some external cooling device such as a heat radiating surface (not shown). This removal of heat from venting chamber 14, which contains vapor at the same pressure as that in low pressure section 26 of evaporator 12, causes the vapor to condense upon wick 22 which covers the entire cooled surface of venting chamber 14.

The capillary action of wick 22 and artery 18 then returns the condensed liquid back to evaporating wick 20 within evaporator 12 where it is again vaporized, so that the evaporation, vapor movement to venting chamber 14, condensing action and liquid return to evaporating chamber 12 is continuous.

It is the continuous unidirectional movement of vapor to venting chamber 14 which permits the removal of non-condensible gases from the system. The unidirectional vapor movement consistently sweeps non-condensible gases into venting chamber 14 along with the moving vapor. Venting chamber 14 is open to a lower pressure region such as a vacuum source at vent pipe 30, so that non-condensible gases are pulled from venting chamber 14 by the pressure differential between venting chamber 14 and the lower pressure region. The access to a lower pressure is particularly convenient in a space environment where all that is required is an open vent pipe to access the vacuum of space, but even in other locations, conventional vacuum pumps can be interconnected with vent pipe 30.

The question which is raised intuitively is, "Why, when there is a lower pressure pulling non-condensible gases out of venting chamber 14, is the vapor not also removed from the system?" However, it is the unique property of a vapor to preferentially condense which essentially diverts the vapor from the vent pipe. It is, in fact, likely that some very small quantity of vapor will exit the vent pipe, but the quantity is insignificant relative to the amount of vapor available at evaporating wick 20.

The condensation of the vapor and prevention of its loss to the vacuum through vent pipe 30 is aided when deflector vanes 23 are added to the structure of wick 22. Deflector vanes 23 are thermally conductive structures attached to cooled surfaces 25 of venting chamber 14 and protrude into the central region of venting chamber 14. Deflector vanes 23 are constructed from or covered with a wick material similar to and continuous with wick 22. Thus, a substantial portion of the internal volume of venting chamber 14 is in very close proximity to cooled wick structure, and the condensation of vapor from within venting chamber 14 is encouraged.

Figure 2:
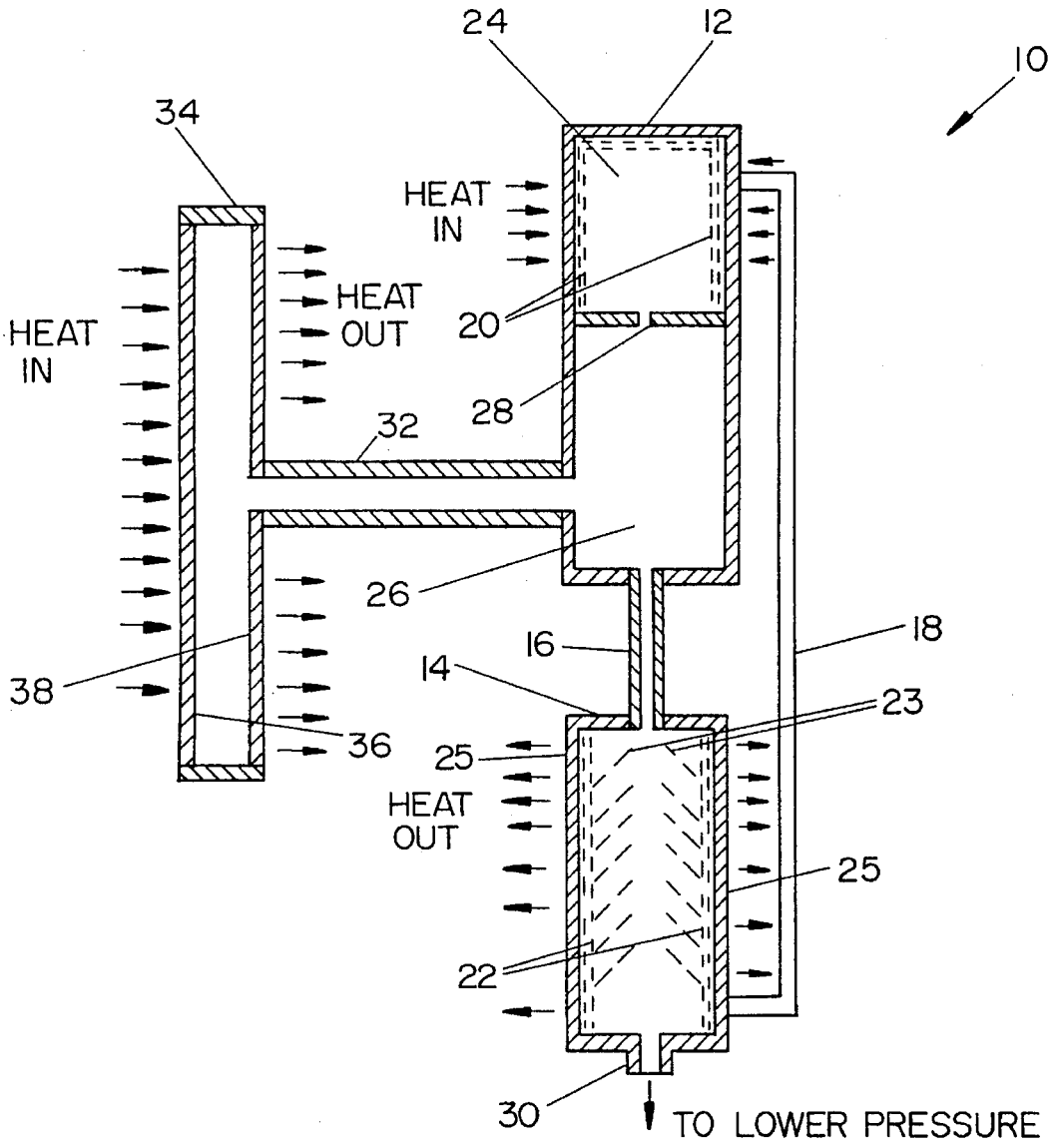
FIG. 2 is a simplified cross section schematic diagram of the preferred embodiment of the invention interconnected with a thermionic energy converter.

FIG. 2 is a simplified cross section schematic diagram of the preferred embodiment of FIG. 1 interconnected through pipe 32 to thermionic energy converter 34 so that any non-condensible gases present within thermionic energy converter 34 will be removed from the system.

Since typical thermionic energy converter 34 operates with emitter 36 subjected to a temperature of 1800 degrees Kelvin, when operated in an environment such as a dual mode nuclear propulsion system, with hydrogen present, it is very likely that hydrogen will permeate into the thermionic energy converter. However, when thermionic energy converter 34 is interconnected with low pressure section 26 of alkali metal vapor source 10 shown in FIG. 1 and in FIG. 2, the hydrogen will be continuously vented from thermionic energy converter 34 and no adverse operation effects will occur.

This continuous venting of hydrogen will occur because alkali metal vapor will diffuse into thermionic energy converter 34 from low pressure section 26 of evaporator chamber 12, and both vapor and hydrogen will also diffuse out of thermionic energy converter 34 back to low pressure section 26. From low pressure section 26, the hydrogen will move into venting chamber 14 and be removed as described in regard to FIG. 1.

One particularly fortunate circumstance for combining thermionic energy converter 34 with alkali metal vapor source 10 is their temperature relationships. When thermionic energy converter 34 is operating with its emitter 36 being heated at the typical temperature of 1800 degrees Kelvin, the output temperature from collector 38 of thermionic energy converter 34 is approximately 900 degrees Kelvin. As discussed previously, 900 degrees Kelvin is an appropriate temperature for the operation of evaporator chamber 12 of alkali metal vapor source 10. Therefore, it is quite practical to transfer heat directly from collector 38 of thermionic energy converter 34 to vapor chamber 12 of alkali metal vapor source 10, and thereby use the waste heat from thermionic converter 34 to power the device which clears thermionic converter 34 of the hydrogen which would otherwise cause it to fail prematurely.

Figure 3:
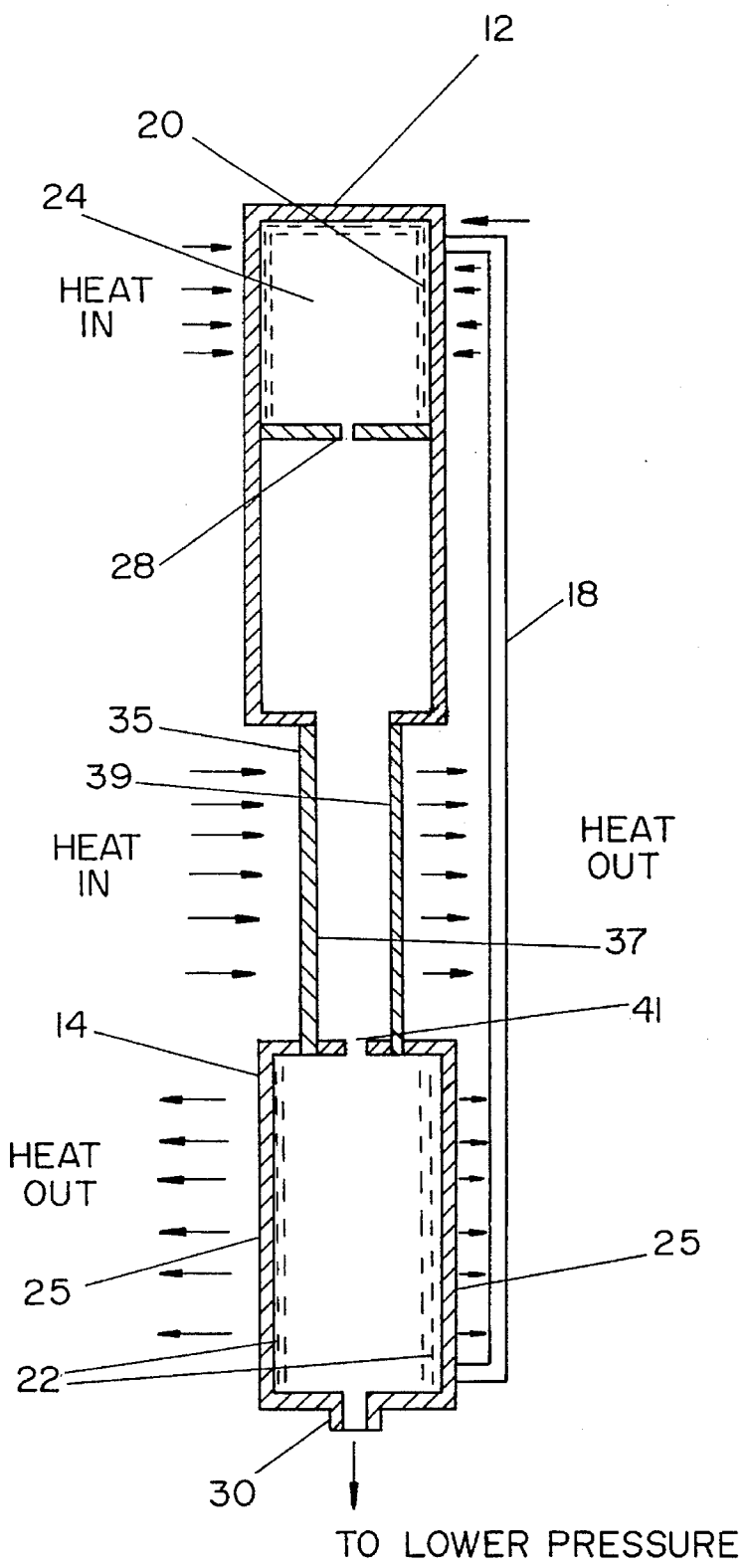
FIG. 3 is a simplified cross section schematic diagram of the preferred embodiment of the invention constructed with a flow through thermionic energy converter.

FIG. 3 is an structure similar to that shown in FIG. 2 except that thermionic energy converter 35 is located between low pressure section 26 and venting chamber 14. This difference in location causes a more aggressive movement of the alkali metal vapor through thermionic converter 35, since the vapor flows through thermionic converter 35 instead of diffusing in and out of it by way of the same pipe 32 (FIG. 2). In other respects thermionic converter 35 operates in the same manner as thermionic converter 34 in FIG. 2 in that emitter 37 is heated and collector 39 is cooled FIG. 3 depicts one addition to thermionic converter 35 in exit orifice 41. Exit orifice 41 is optional within thermionic converter 35 and furnishes a control of the vapor leaving thermionic converter 35 so that the vapor pressure within the thermionic converter can be more accurately controlled. FIG. 3 also shows venting chamber 14 without the use of deflector vanes 23 (FIGS. 1 and 2). Depending upon the heat removal from and the particular geometry of the venting chamber, such deflector vanes are not always required.

Figure 4:
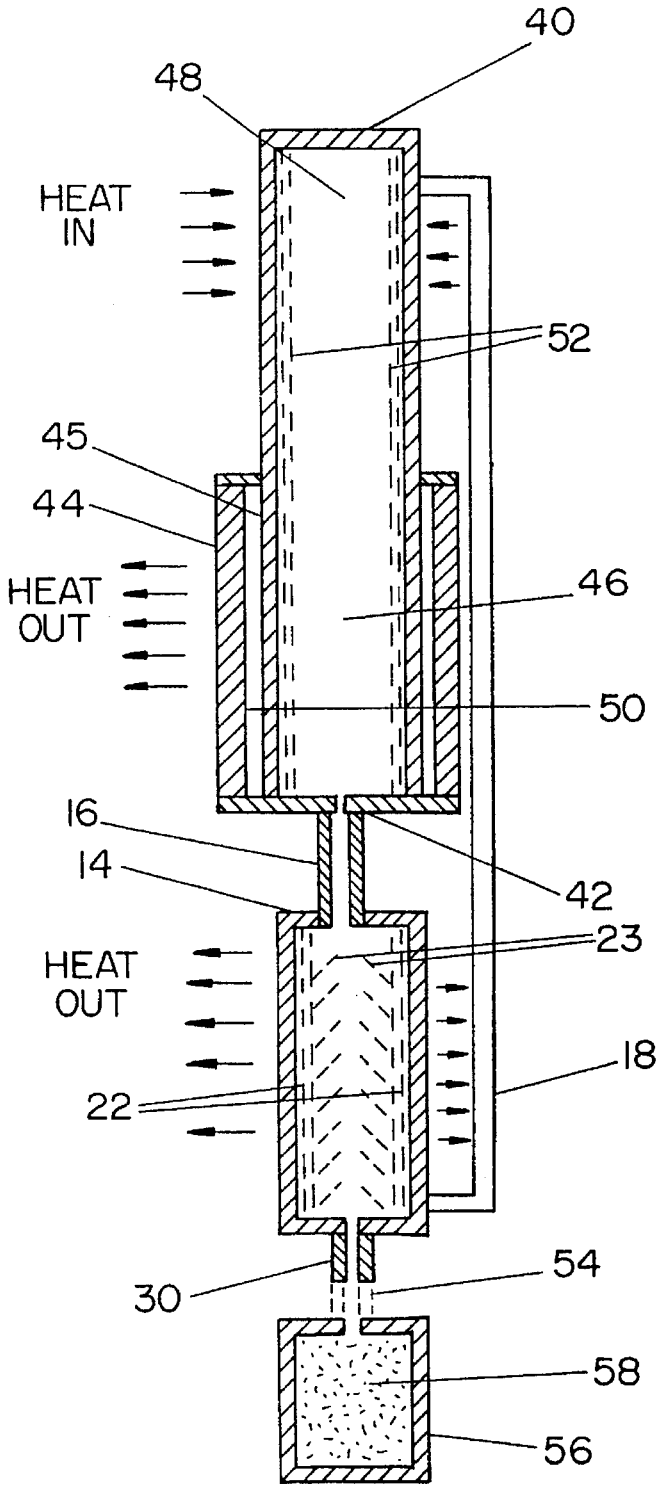
FIG. 4 is a simplified cross section schematic diagram of an alternate embodiment of the invention used with a heat pipe.

FIG. 4 is a simplified cross section schematic diagram of an alternate embodiment of the invention which continuously disposes of any non-condensible gases which are present within an associated heat pipe.

In FIG. 4, venting chamber 14 and artery 18 are constructed and operate in the same manner as described in conjunction with FIG. 1, but the evaporator chamber is heat pipe 40 and is constructed and operates somewhat differently from evaporator chamber 12 of FIG. 1. Essentially, evaporator chamber 40 is constructed as a conventional heat pipe, and its only significant difference from a conventional heat pipe is the presence of sonic orifice 42 and the heat pipe's attachment to artery 18.

Heat pipe 40 can also be integrated with thermionic energy converter 44 in a conventional manner by constructing the casing external to condensing region 46 of heat pipe 40 as emitter 45 of thermionic energy converter 44, so that heat transferred from evaporator region 48 of heat pipe 40 to condensing region 46 is conducted to and heats thermionic energy converter 44. The heat operating thermionic energy converter 44 is then disposed of from the exterior of collector 50 of thermionic converter 44. The present invention is, however, independent of the application for which heat pipe 40 is used.

If, for example, heat pipe 40 uses lithium as its working fluid, the applied heat to which evaporator region 48 is subjected vaporizes liquid lithium within the portions of wick 52 which are located in evaporator region 48. As is conventional with all heat pipes, the lithium vapor migrates to condenser region 46 of heat pipe 40, and because of the removal of heat, either by operating thermionic energy converter 44 or by some other heat removal means, the vapor condenses upon and within the portions of wick 52 which are within condensing region 46. This condensed liquid lithium is then returned to evaporator region 48 of heat pipe 40 by capillary action of wick 52, where it is again vaporized. This operation is quite conventional for heat pipes.

The present invention for removing non-condensible gas from a heat pipe adds to this conventional structure and is also independent of the particular heat transfer fluid with which the heat pipe operates.

Sonic orifice 42 is located in condensing region 46 of heat pipe 40 and, as described in relation to FIG. 1, permits controlled leakage of vapor from heat pipe 40. Since heat pipes operate at significant vapor pressures, sonic orifice 42 permits vapor to leave condensing region 46, but the amount of leakage is limited and the vapor pressure on the downstream side of sonic orifice 42 is much lower than the vapor pressure within heat pipe 40. The vapor at reduced pressure then migrates through tubing 16 and into venting chamber 14, where, as described in regard to FIG. 1, the vapor is condensed upon wick 22 and deflector vanes 23, and is returned to wick 52 of heat pipe 40 through artery 18 by capillary action.

Also, as described in relation to FIG. 1, any non-condensible gas which is present within heat pipe 40 is carried out of heat pipe 40 by the vapor leaving through sonic orifice 42, is swept through venting chamber 14 with the vapor, and while the vapor is intercepted by condensing wick 22 and deflector vanes 23, the non-condensible gas leaks out of venting chamber 14 through vent 30 and to the low pressure or environment.

FIG. 4 depicts another variation of the invention which can be used to dispose of non-condensible gases in some applications. FIG. 4 shows the optional interconnection (with dotted lines 54) of vent 30 to gettering chamber 56 which contains getter material 58. As is well understood in the art of vacuum technology, there are many materials which absorb specific non-condensible gases, usually by chemically interacting with the gases. For instance, hydrogen is absorbed by titanium under appropriate conditions of temperature and hydrogen partial pressure.

Therefore, when getter material 58 is titanium wire or powder within gettering chamber 56, and since gettering chamber 56 is located in the coolest location of the structure, the titanium absorbs hydrogen from within venting chamber 14 and creates a lower partial pressure of hydrogen in the region of getter material 58, causing additional hydrogen to be removed from venting chamber 14. The presence of getter material therefore makes it unnecessary to provide access to a lower pressure or vacuum region to dispose of non-condensible gas. Furthermore, gettering chamber 56 need not be a separate structure, and can be included within venting chamber 14, thus eliminating vent 30. Under such circumstances, the getter material can even be used as part of the structure of venting chamber 14. For instance, when wick 22 is constructed of titanium it performs the functions of collecting and transporting the condensing vapor while also trapping the hydrogen.

The invention therefore provides an apparatus for removing non-condensible gases from vapor environments associated with any vapor source, and is particularly useful in removing hydrogen from alkali metals vapor sources and heat pipes.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, venting chamber 14 can be used with a suitably low pressure vapor source without the need for a sonic orifice, since the purpose of the sonic orifice is to reduce the pressure within venting chamber 14 and thereby reduce the vapor lost from the system. Moreover, the specific vapor in the system is not important except for the temperatures used, since the invention can distinguish between any non-condensible gas and a condensible vapor. The invention could also use a valve or other flow restrictor instead of the sonic orifice.

What is claimed and for which Letters patent of the United States are desired to be secured is:

1. A vapor source which generates vapor and removes non-condensible gases from the vapor, comprising:

an evaporator chamber;

an evaporating wick structure located within the evaporator chamber and subjected to heat;

a venting chamber;

a condensing wick located within the venting chamber so that the condensing wick transfers heat to a cooled portion of the venting chamber;

vapor flow means interconnecting the evaporator chamber and the venting chamber so that vapor generated at the evaporating wick moves to the condensing wick;

capillary means interconnecting the condensing wick and the evaporator wick so that liquid condensed at the condensing wick is transported to the evaporating wick;

liquid located within the evaporator chamber so that the liquid is vaporized by the heat to which the evaporator wick is subjected and condensed at the condensing wick; and open vent means interconnecting the venting chamber to a region of lower pressure than the pressure which exists within the venting chamber, so that non-condensible gases within the venting chamber are removed from the venting chamber.

2. The vapor source of claim 1 further including a pressure drop means located in the vapor flow path between the evaporating wick and the condensing wick so that the pressure in the venting chamber is lower than the pressure in the evaporating chamber.

3. The vapor source of claim 1 further including a sonic orifice located in the vapor flow path between the evaporating wick and the condensing wick so that the pressure in the venting chamber is lower than the pressure in the evaporating chamber.

4. The vapor source of claim 1 further including a thermionic energy converter interconnected to the venting chamber so that vapor and non-condensible gases within the thermionic energy source flow from the thermionic energy converter into the venting chamber.

5. The vapor source of claim 1 wherein the evaporator chamber is a heat pipe with an evaporating wick and a condensing region, with the condensing region interconnected to the venting chamber so that vapor and non-condensible gases within the condensing region flow from the condensing region of the heat pipe into the venting chamber, and with the capillary means interconnecting the evaporating wick in the heat pipe with the condensing wick in the venting chamber.

6. A vapor source which generates vapor and removes non-condensible gases from the vapor, comprising:

an evaporator chamber;

an evaporating wick structure located within the evaporator chamber and subjected to heat;

a venting chamber;

a condensing wick located within the venting chamber so that the condensing wick transfers heat to a cooled portion of the venting chamber;

vapor flow means interconnecting the evaporator chamber and the venting chamber so that vapor generated at the evaporating wick moves to the condensing wick;

capillary means interconnecting the condensing wick and the evaporator wick so that liquid condensed at the condensing wick is transported to the evaporating wick;

liquid located within the evaporator chamber so that the liquid is vaporized by the heat to which the evaporator wick is subjected and condensed at the condensing wick; and getter means interconnected with the venting chamber so that non-condensible gases within the venting chamber are absorbed by the getter means and removed from the venting chamber.

* * * * *